US009956698B2

(12) United States Patent
Liberatore

(10) Patent No.: US 9,956,698 B2
(45) Date of Patent: May 1, 2018

(54) DUAL SIDED RAZOR

(71) Applicant: Mack-Ray Inc., Bentonville, AR (US)

(72) Inventor: Raymond A. Liberatore, Bentonville, AR (US)

(73) Assignee: Mack-Ray, Inc., Bentonville, AR (US)

( * ) Notice: Subject to any disclaimer, the term of this patent is extended or adjusted under 35 U.S.C. 154(b) by 0 days. days.

(21) Appl. No.: 15/288,749

(22) Filed: Oct. 7, 2016

(65) Prior Publication Data

US 2017/0021513 A1 Jan. 26, 2017

Related U.S. Application Data

(63) Continuation of application No. PCT/US2015/018872, filed on Mar. 5, 2015.

(60) Provisional application No. 61/948,203, filed on Mar. 5, 2014.

(51) Int. Cl.

| | |
|---|---|
| ***B26B 21/22*** | (2006.01) |
| ***B26B 21/40*** | (2006.01) |
| ***B26B 21/44*** | (2006.01) |
| ***B26B 21/52*** | (2006.01) |

(52) U.S. Cl.

CPC ..... *B26B 21/225* (2013.01); *B26B 21/4012* (2013.01); *B26B 21/4037* (2013.01); *B26B 21/443* (2013.01); *B26B 21/521* (2013.01)

(58) Field of Classification Search

CPC .. B26B 21/222; B26B 21/225; B26B 21/2276
USPC ..... 30/50, 51
See application file for complete search history.

(56) References Cited

U.S. PATENT DOCUMENTS

| | | | | |
|---|---|---|---|---|
| 4,854,042 | A * | 8/1989 | Byrne | B26B 21/28 30/34.1 |
| 5,133,131 | A * | 7/1992 | Hoffman | B26B 21/222 30/47 |
| 5,575,068 | A * | 11/1996 | Pedersen | B26B 21/222 30/47 |
| 5,784,790 | A | 7/1998 | Carson et al. | |
| 5,787,586 | A | 8/1998 | Apprille, Jr. et al. | |
| 5,813,293 | A | 9/1998 | Apprille, Jr. et al. | |
| 5,855,071 | A | 1/1999 | Apprille, Jr. et al. | |
| 5,918,369 | A | 7/1999 | Apprille, Jr. et al. | |
| 5,956,851 | A | 9/1999 | Apprille, Jr. et al. | |
| 6,026,577 | A | 2/2000 | Ferraro | |

(Continued)

FOREIGN PATENT DOCUMENTS

| | | |
|---|---|---|
| RU | 63734 U1 | 6/2007 |
| WO | 99/04938 A1 | 2/1999 |

(Continued)

OTHER PUBLICATIONS

International Search Report with the Written Opinion issued for corresponding International Patent Application No. PCT/US 2015/018872 dated Jun. 4, 2015.

(Continued)

*Primary Examiner* — Andrea Wellington
*Assistant Examiner* — Fernando Ayala
(74) *Attorney, Agent, or Firm* — Myers Wolin, LLC

(57) ABSTRACT

A dual sided razor cartridge comprising a first face and a second face opposite the first face, at least one razor blade extending between the first and second faces, and at least one handle engagement compartment positioned on each face for engagement of the cartridge with a razor handle.

18 Claims, 18 Drawing Sheets

(56) References Cited

U.S. PATENT DOCUMENTS

| | | | | |
|---|---|---|---|---|
| 6,029,354 | A | 2/2000 | Apprille, Jr. et al. | |
| 6,141,875 | A | 11/2000 | Andrews | |
| 6,311,400 | B1 | 11/2001 | Hawes et al. | |
| 6,317,990 | B1 | 11/2001 | Ferraro | |
| 6,493,950 | B1 * | 12/2002 | Kludjian | B26B 21/22 30/298 |
| 7,086,160 | B2 * | 8/2006 | Coffin | B26B 21/222 30/50 |
| 7,168,173 | B2 | 1/2007 | Worrick, III et al. | |
| 7,681,320 | B2 * | 3/2010 | Szczepanowski | B26B 21/225 30/34.05 |
| 7,690,122 | B2 | 4/2010 | Worrick, III et al. | |
| 7,770,294 | B2 | 8/2010 | Bruno et al. | |
| 9,550,303 | B2 * | 1/2017 | Robertson | B26B 21/521 |
| 2001/0003869 | A1 * | 6/2001 | Rocha | B26B 21/22 30/41 |
| 2008/0209734 | A1 * | 9/2008 | Nicoll | B26B 21/44 30/41 |
| 2009/0071008 | A1 * | 3/2009 | Hart | B26B 21/222 30/34.05 |
| 2009/0188112 | A1 * | 7/2009 | Prochaska | B26B 21/222 30/34.05 |
| 2010/0170094 | A1 * | 7/2010 | Hayashi | B26B 21/222 30/50 |
| 2011/0119922 | A1 * | 5/2011 | Ntavos | B26B 21/222 30/32 |

FOREIGN PATENT DOCUMENTS

| | | | |
|---|---|---|---|
| WO | 2012/028413 | A1 | 3/2012 |
| WO | 2012/172381 | A1 | 12/2012 |

OTHER PUBLICATIONS

Notice of First Office Action for corresponding Chinese Patent Application No. 2015800221562 dated Dec. 1, 2017 with a partially summarized English translation.

* cited by examiner

DUAL SIDED RAZOR

CROSS-REFERENCE TO RELATED APPLICATIONS

This application is a continuation of International Application No. PCT/US15/18872, Filed on Mar. 5, 2015, which claims the benefit of U.S. Provisional Patent Application, No. 61/948,203, filed Mar. 5, 2014, the contents of each of which are hereby incorporated by reference in their entirety.

FIELD OF THE INVENTION

The present invention relates generally to shaving systems, and more particularly to a replaceable, double-sided blade unit for a shaving system.

BACKGROUND

Typical razors have one-five blades only on one side, and when they get dull, they are thrown away. A typical consumer either buys disposable razors or replacement cartridge type razors. The disposable razors are less expensive, and the replacement cartridge type razors cost significantly more. One problem is that consumers are forced to pay high prices for razors with cartridges and even higher prices for the replacement cartridges that are sold.

SUMMARY

Since many consumers do not want to pay high prices for razors but have no choice in the matter, the dual sided razor allows consumers to have a longer shave by having a razor cartridge that the consumer can use both sides of the cartridge. This can save consumers money, so they don't have to buy as many razor replacement cartridges during the year because the razor can last twice as long. The dual sided razor provides consumers a market in the middle. This invention gives consumers another choice in shaving by offering consumers a double shave, preserving quality, and saving consumers money.

With the dual sided razor, there are from one to five blades in a dual sided cartridge, and there is a sharp edge for shaving on each end of the blade. This way, the consumer can use one side of the razor until it is dull, and then use the other side of the razor cartridge, thereby shaving twice as long. The razor utilizes both ends of the razor blade instead of wasting the other end of the razor blade that is not used for shaving or is not designed for shaving. The user then disconnects the double-sided razor cartridge from the handle engagement connection, flips over or turns over the razor cartridge, and attaches it to the other side of the dual sided cartridge razor. The user would use this second side of the razor cartridge until it's dull. When the razor cartridge is dull, the user would take the dual sided cartridge off and apply a new dual sided cartridge to the razor handle. This should give consumers double the shave utilizing both ends of the razor blade.

A user could buy a razor that comes with the dual sided cartridges already attached. Or, the user could buy replacement cartridges and replace the existing dual sided razor cartridges.

To connect and disconnect the razor to and from the dual sided cartridge, the user would hold the handle with one hand, and hold the dual sided cartridge ends (the end and sides where there are no blades) with the other hand. Then, the user would put the handle engagement connection areas, located on the handle, into the attachment compartment on the cartridge face connection compartments or slots until it connects, fits inside, and preferably locks into the cartridge compartment area.

In one embodiment, an easy connection occurs if the razor handle and the handle engagement connection are perpendicular to the cartridge attachment compartment face when inserting (connecting or disconnecting). There can be many ways of inserting (connecting or disconnecting) the handle engagement connection (razor handle) and the dual sided cartridge, known now or developed in then future. While certain embodiments are described herein, it will be appreciated that other embodiments are contemplated.

The present disclosure allows consumers to save money by providing twice the shave as normal razors and cartridges. This way, consumers can spend less money a year on razors. This concept is very useful and is much needed in the marketplace. Unlike previous concepts of a two-sided razor, the razor of the present embodiments described herein has a new and improved way to bring consumers a dual sided razor with a great shave, double the shave, thereby saving consumers money. There are many unique aspects of the present disclosure that make it an easy way for consumers to use a razor cartridge that can be used to shave on both sides.

The dual sided razor designed as a dual sided disposable razor can have all the specifications replaceable and elements mentioned in this application. The dual sided disposable razor can be any shape, design, size and be made of any material known now or developed in the future. One non-limiting difference between a dual sided disposable razor and a dual sided non-disposable razor is that the disposable razor blades and cartridges might be made of less expensive materials and designed to be used only a limited number of times and thrown away.

DETAILED DESCRIPTION OF THE PREFERRED EMBODIMENTS

Figure 1:
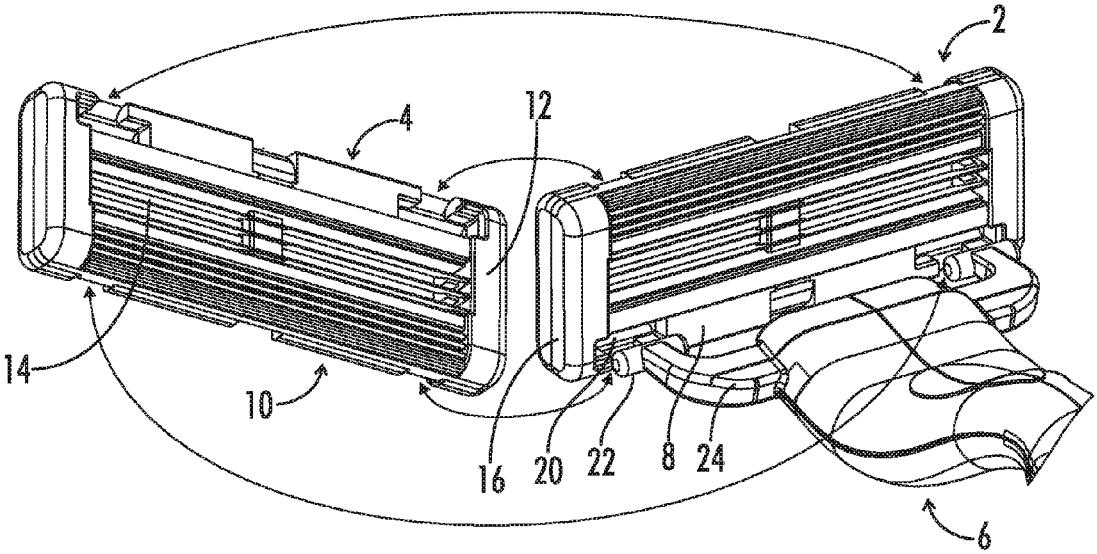
FIG. 1 is a perspective view of one embodiment of a razor system comprising one embodiment of a cartridge of the present disclosure connected to an embodiment of a handle of the present disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

As seen in FIG. 1, one embodiment of a razor cartridge 2 of the present disclosure has an upper end section 4, which is furthest away from the handle 6 as illustrated. The upper end section can be shaped like an oval, rounded, or have any shape. If it is rounded, then the cartridge face 8 can have rounded pads, strips, or moisturizing pads, or other attachments or features as desired. The lower section (end sections) 10, or any sections of the razor, can be shaped any way known now or developed in the future. The cartridge ends or edges 12 can have rubber, or any material known now or developed in the future, to help the user grip the cartridge ends 12, such as while in water or out of water. The edges may be contoured, ridged, concave, convex or combinations of the same. This also helps the user grasp and connect or disconnect the cartridge 2 from the handle 6, and switch (flip) the cartridge 2 along an axis running along the central longitudinal axis of the cartridge to use the other size of the razor as illustrated in FIG. 1. When handling the dual sided razor, it is preferred that the user holds the cartridge ends or edges 12 and not the blade 14 itself or cartridge face 8. The user could get cut holding the blade 14 or cartridge face 8. The cartridge ends 12 can have finger grooves 16, where there is a concave and/or convex area for the user's fingers to fit comfortably and grip the cartridge 2 easily and securely. The cartridge face 8 also preferably contains a cartridge attachment compartment 20 into which handle engagement connections 22 fit. The handle engagement connection 22 extends off of a flange 24 (arms or wing area). There can be rounded pads, strips, or moisturizing pads that match the shape of the cartridge top, bottom, or sides.

The cartridge 2 can be made of any type of material, such as plastic, rubber, metal, or the like, combinations of the same. Any type of material, such as rubber, can be located anywhere on the cartridge 2. The cartridge 2 can be made of any number of pieces. The cartridge 2 can be assembled with screws, snap fit, heat welded, ultrasonically welded, locked, or any way known now or developed in the future. The cartridge 2 can be any size or shape. In one embodiment, it can be designed and shaped like straight edge razors or cartridge type razors. The cartridge 2 can have any amount of blades 14, fastened permanently or non-permanently, such as one-blade, two-blades, three-blades, five-blades. The blades 14 can be any angle degree percentage to the shaving surface, however it is preferred to have the blades oriented at sixty degrees to the shaving surface, although other angles are possible.

In one embodiment, the cartridge halves or pieces can be snapped together permanently or be removable. It can be attached any way known now or developed in the future. It is preferred if the cartridge pieces form a permanent attachment. Once the two cartridge halves are attached together, then the cartridge 2 can be heat sealed or ultrasonically welded together to make a permanent attachment so it cannot come apart which makes it safer. The ultrasonic welding or heat sealing ensures the snap fit or any type of connection will keep the cartridge pieces and razors intact as one, so it never comes apart, making it very safe. The cartridge pieces can be held together with metal or a steel band that holds the two ends together. Other means of securing are possible. The bands can hold the two cartridge pieces together securely. There are many ways that the cartridge pieces can be bonded or attached securely that is known now or developed in the future.

The cartridge face 8, or the shaving surface side, can be designed as two different pieces or be designed as one piece. In one embodiment of a one-piece design, the topside, such as where pads and moisturizing pads are located, can look the same. The other side (inside surface or interior area), in one embodiment, can be designed to look the same where the blades 14 are attached.

Figure 2:
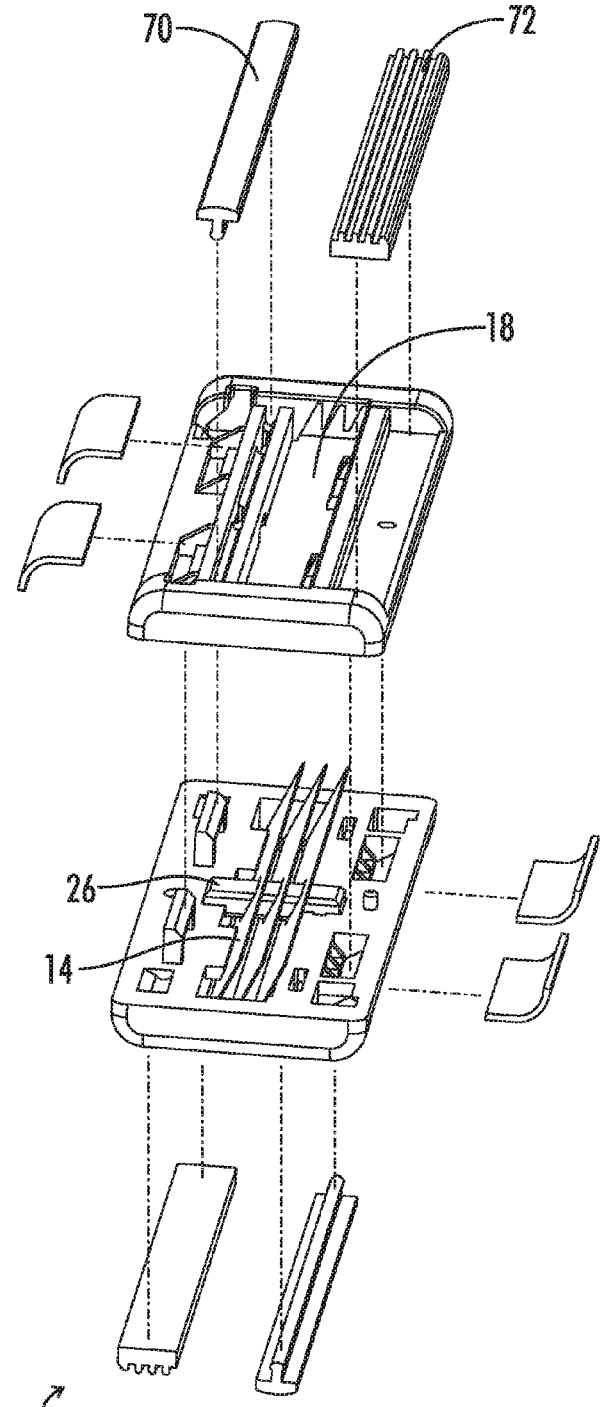
FIG. 2 is an exploded view and FIG. 3 is a partially assembled view of one embodiment of a cartridge.
Figure 3:
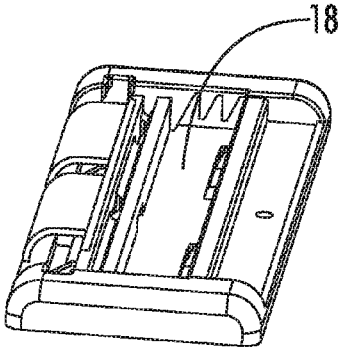
Figure 4:
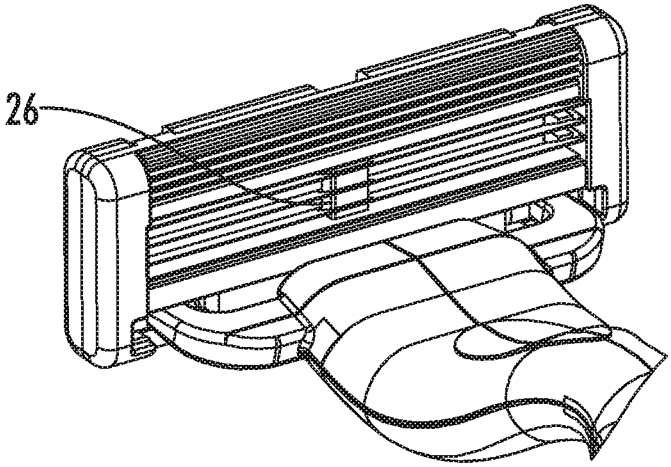
FIGS. 4-5 are perspective rear views of an embodiment of a handle engaged with a cartridge, with FIG. 4 showing an engagement/release position and FIG. 5 showing a use position with the cartridge pivoted away from the engagement/release position.
Figure 5:
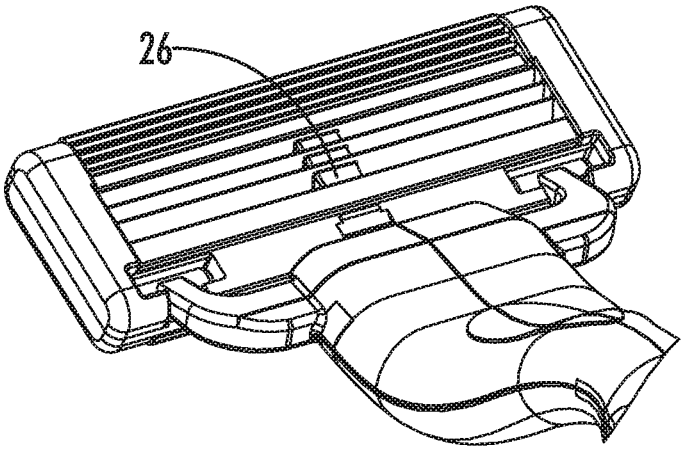

As seen in the embodiment of FIGS. 2 and 3, there is provided blade grooves 18 into which the blades 14 are inserted, in a right angle, for a right blade angle on the shaving surface. The angle will be suitable for one side of the cartridge 2 for the shaving surface (side one). The other end of the blade groove 18, which the blades 14 fit into, is suitable for the other shaving surface (side two) of the cartridge 2. As seen in FIGS. 4 and 5, there is a blade centerpiece 26 that goes through the middle of each razor blade 14 to stabilize and hold the razor in place on the inside of the cartridge 2. FIG. 4 illustrates the attachment of the handle to a face of the blade cartridge, where the blade cartridge is suitably angled to receive and engage the handle, whereas FIG. 5 illustrates the pivoting of the cartridge relative to the handle into a use position for shaving. When it is desired to remove the cartridge from the handle, the cartridge is pivoted from the position shown in FIG. 5 to the position shown in FIG. 4 and then the cartridge is capable of being separated from the handle.

There can be connections where the blade centerpiece 26 is attached securely and permanently to the cartridge surface, once the blade centerpiece 26 goes through the blades 14. The connection can be heat or ultrasonically welded or any way to attach and connect that is known now or developed in the future. This blade centerpiece 26 helps the razor blade 14 be sturdy, especially in the middle section of the razor blade 14. The middle section of the blade 14 needs stabilization because of the blade span, so the blade centerpiece 26 helps keep the blades 14 straight and strong while shaving. This blade centerpiece 26 can be made of any material or plastic. The razor blade 14 is designed and shaped to be able to fit this blade centerpiece 26 securely.

The blade centerpiece 26 is placed down the center of the razor blade 14 as shown in FIG. 2 or it can go through any part of the razor blade 14 other than the center. Once the blade centerpiece 26 goes through the center of the blades 14, then the blade centerpiece 26 can be attached permanently or non-permanently to the one side of the cartridge 2. Then the other side of the cartridge can be placed over the blades 14, blade centerpiece 26, and the other interior part of the cartridge 2. They can be sandwiched together by a snap fit or any connection known now or developed in the future. The blades 14 that go into the blade grooves 18 will have one of the top or free ends exposed, and as the top cartridge 2 fits over the blades 14 and blade centerpiece 26, the top side of the blades 14 will fit into the blade grooves 18 on the interior part of the other cartridge 2 side.

The other cartridge 2 side (interior side) can be designed to have the interior portion fit perfectly together and form one unit where there is a connection. There can be snap fit mechanisms or any type of connection known now or developed in the future. One side can have connection prongs (male section) and the other side can have the prong compartment areas (female sections) where the prong goes inside and cannot come back out. So each interior razor cartridge can have one side that has prongs and the other side has the connection compartments.

In one embodiment, each cartridge piece or half can be identical, and when the two cartridge pieces or halves are connected together, the user would have to turn the cartridge 2 around so opposite ends are attached and connected to each other. The dual sided razor can be designed without having to turn the cartridge around. When attaching the cartridges, both cartridge attachment compartment areas and pushpin engagement areas (the attachment face) are opposite from one another. The interior portion is preferably configured to look the same with blade grooves 18 and placement for the blades. One difference is with the prongs and the prong compartment connection areas; one is on each long end of the cartridge interior.

In one embodiment, the cartridge can also be two different designed pieces, or be any number of pieces, to accomplish the same. The cartridge can be designed differently on the inside and outside but still remain connected together. The cartridge can remain connected together any way known now or developed in the future.

Figure 6:
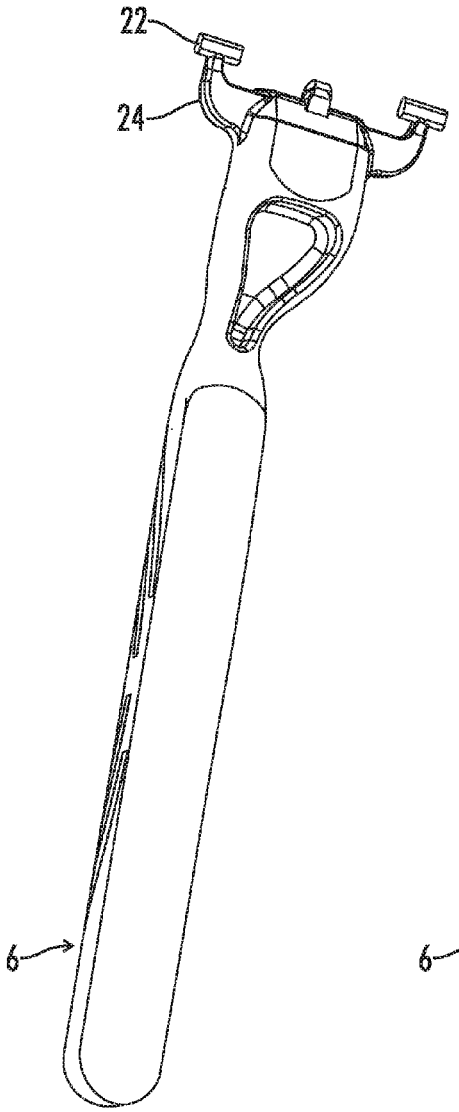
FIG. 6 is a perspective front view of one embodiment of a handle without a cartridge.
Figure 7:
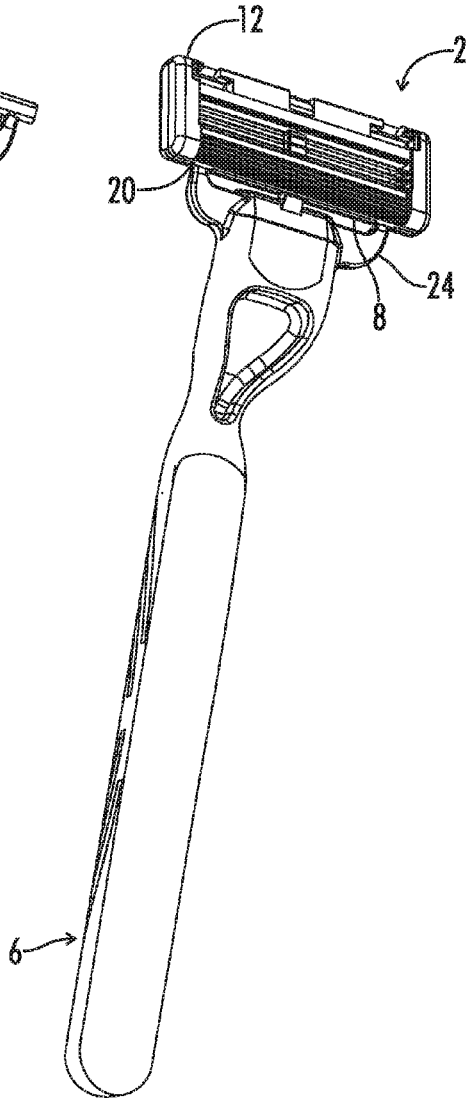
FIG. 7 is a perspective front view of one embodiment of a cartridge embodiment connected to the handle of FIG. 6.

As seen in the embodiment of FIGS. 6 and 7, the handle 6 has an attachment at each end where the handle 6 can attach to each side of the cartridge face 8 or any location. This is what makes the handle 6 of this dual sided razor unique, namely that it attaches to and engages with a cartridge face. There is a flange 24 (arms or wing area) at the end of the handle 6 and two handle engagement connection areas 22 that fit inside both ends of the cartridge attachment compartments 20 (swivel compartments).

The flange 24 (arms or wing area) can be any shape, size, or design. The two handle engagement connections 22 on the handle 6 can be any shape or size and can have one to any number handle engagement connections 22 to connect to the cartridge 2. The handle engagement connections 22 can be any shape, size, or design, such as round or oval, known now or developed in the future. The handle 6 and handle engagement connection 22 areas can be any size or shape and can be made from material known now or developed in the future.

The handle 6 and/or flange 24 (arms or wing area) can have a grip insert made of a rubber or plastic grip type material that is injected into the plastic. Or, materials, plastic, or rubber gripping can be attached on the front or back of the handle 6 or anywhere on the cartridge 2 or cartridge ends 12. The handle 6 can be made from, for example, plastic, rubber, plastic rubber, steel, stainless steel, or any kind of material known now or developed in the future. The handle 6 can be chrome plated or have chrome. Other materials are contemplated.

The flange 24 (arms or wing area) that extends from the handle 6 can be angled to provide the proper angle and position during the shave and in relation to the handle 6. As a user holds the handle 6 and shaves, the shave is easy, comfortable, and all contours and surfaces of shaving are covered. The flange 24 (arms or wing area) could be any angle. There could be one to any number of flanges (arm or wing area) 24. The handle engagement connection ends that connect the cartridge can be any shape, oblong, oval, round, arrow, shaped, square, any combination, or any design or shape known now or developed in the future. Other shapes are contemplated.

Figure 8:
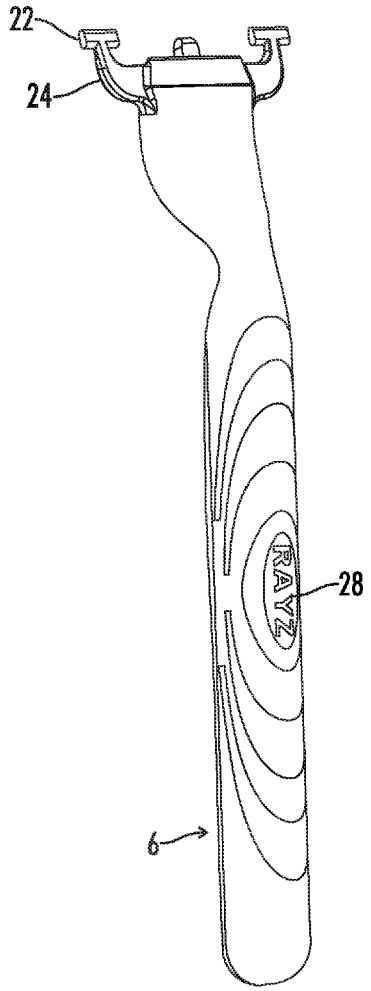
FIG. 8 is a perspective rear view of one embodiment of a handle embodiment containing a logo.
Figure 9:
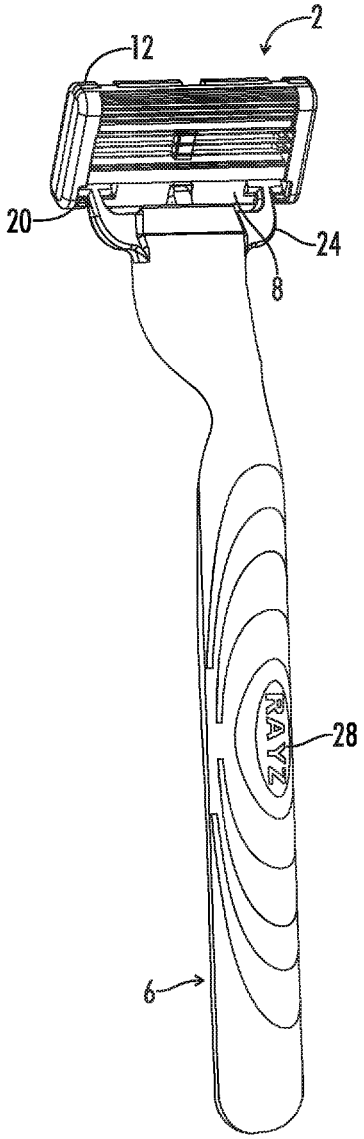
FIG. 9 is a perspective rear view of one embodiment of a cartridge connected to the handle of FIG. 8.

As seen in FIGS. 8 and 9, the handle 6 can also contain logos or branding marks 28. The logos or branding marks 28 can be made of rubber inserts, for example. The rubber inserts can be made of any material that aids the user in gripping the surfaces while being wet or under water, such as rubber or plastic. Other materials, types of branding, logo placements and the like are contemplated.

Figure 10:
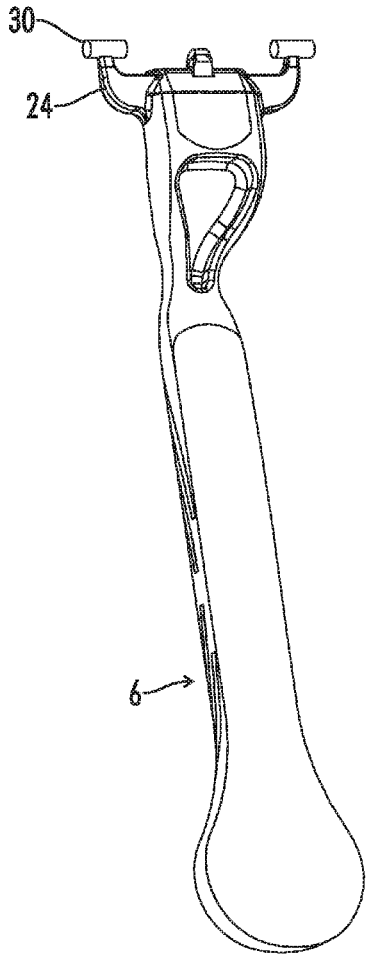
FIG. 10 is a perspective front view of one embodiment of a handle containing one embodiment of a handle engagement.
Figure 11:
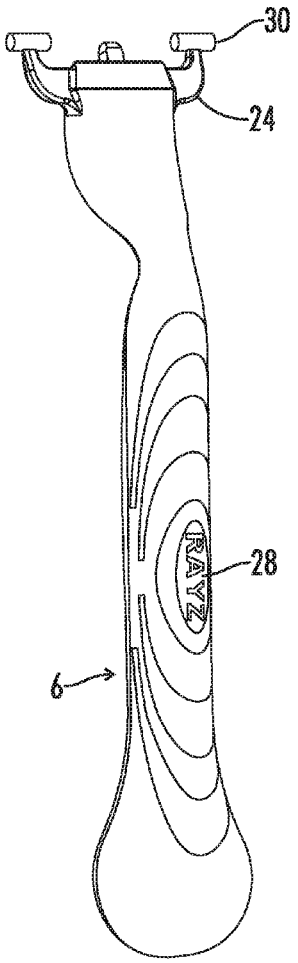
FIG. 11 is a perspective rear view of the handle of FIG. 10.

As seen in the embodiment of FIGS. 10 and 11, the handle engagement connections 22 are in the form of a round (cylindrical) connection 30, and this round (cylindrical) connection 30 area attaches to the cartridge face 8 or inside the cartridge attachment compartment 20. The cartridge face 8 has a unique attachment area to mate with the handle engagement connection 22. The cartridge face 8 connection area typically would mate the shape of the handle engagement connection 22 or fit like a puzzle (one piece fits into the outer shape of another piece). The handle engagement connection 22 can be stiff and or flexible and made of any material known now or developed in the future.

The connection area between the cartridge 2 and handle 6 can be flush with the shaving surface, recessed, or the same height as blades 14 or pads. The connection surface can have areas inside it to aid the handle 6 to be able to swivel. The cartridge 2 can be attached to the handle attachment connections by putting one handle engagement connection 22 in first, and then connecting another handle engagement connection 22 inside the cartridge connection area (see FIG. 4). Or, the handle engagement connection 22, or connections, can be inserted at the same time. Removing the cartridge 2 from the handle engagement connections 22 can be done one at a time or at the same time. It is preferred that the cartridge is initially angled relative to the handle as shown in FIG. 4 during the engagement and disengagement of the cartridge with the handle.

The swivel angle (attachment area degree) can be any amount. While shaving, the handle 6 is guided by the user. As the user glides among the different angles of any skin location, such as the face, under arms, or legs, the cartridge 2 swivels at different degrees around the handle engagement connection 22. The inside of the cartridge attachment compartment 20 area and the outside surface of the handle engagement connection 22 move back and forth and swivel while in use.

Certain cartridges have the wing swivel area attached to the cartridge and the handle attaches to this wing swivel area. If the dual sided razor cartridge of the present disclosure had a built-in flanges (arms or wing area) 24, the area could be any size, angle, shape, or design known now or developed in the future. The handle engagement connection 22 area can be any shape or size or design, and it can have a connection known now or developed in the future that will accomplish the same purpose.

The handle engagement connections 22, which can be rounded, are preferably only rounded to a certain percentage. This percentage of the rounded portion can determine the degree that the cartridge 2 will swivel. The percentage can also determine the degree that the handle engagement connection 22, or connections, area will swivel inside the cartridge attachment compartment area 20. This is one way the swiveling can work, although it can work anyway known now or developed in the future. This handle attachment type not only connects to both sides of the cartridge face 8, but it also has a special connection or connections that allow a portion of the handle engagement connection to have the cartridge compartment connection area swivel around it, to one or any number of degrees or angles. The percentage can also allow a portion of the cartridge compartment connection area to swivel around the handle engagement connection to one or any number of degrees or angles. The engagement connection between the handle and the cartridge is also designed and configured to prevent improper placement of the cartridge relative to the handle, and is also designed and configured to prevent over-rotation of the handle relative to the cartridge. This is a very unique aspect of the handle of the present disclosure.

Figure 12:
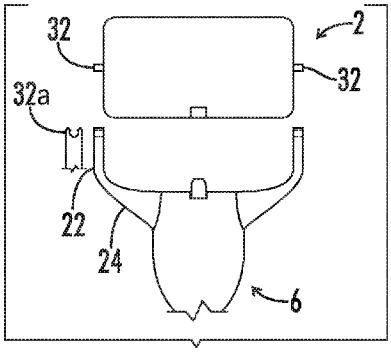
FIG. 12 is a diagrammatic view of one embodiment of a swivel connection.

As seen in the embodiment of FIG. 12, the handle engagement connection 22 area can also be designed to attach to swivel connections that are already attached to the dual sided cartridge 2. The handle engagement connection 22 can also attach inside a swivel compartment area 32 of the dual sided cartridge 2. There would be cartridges 2 and swivel compartment areas 32 on both sides. There would be a swivel bar piece 32*a* that goes inside each swivel compartment area 32 of the dual sided cartridge face 8 and attaches (connects together) separately or as one piece. This section would swivel within the cartridge area. Then, the handle engagement connection 22 would attach to the swivel bar piece 32*a*. FIG. 12 illustrates one embodiment of attaching the handle to the dual sided razor cartridge. All other specifications described can be used enclosed in this type of attachment.

Figure 13:
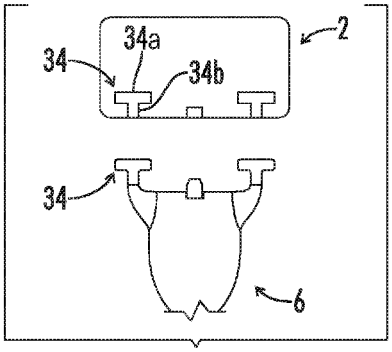
FIG. 13 is a diagrammatic view of one embodiment of a "T" connection.

As seen in the embodiment of FIG. 13, the attachment compartment area on the cartridge face can have a "T" shape connection 34: a long, narrow horizontal opening 34*a* with a smaller perpendicular opening 34*b* running downward below the long horizontal opening 34*a*. There are two connection areas, one on the handle 6 and one the cartridge face. The "T" shape handle engagement connections, fit through the cartridge perpendicular opening 34*b* and move up and down at the same time the user shaves. There can be one to several "T" connections 34 and several handle engagement connections on the handle 6. There can also be one to several cartridge attachment compartments on both ends of the cartridge face. The "T" connection areas 34 can be any size or shape designed now or known in the future to accomplish the same concept, including a shape other than a "T."

The horizontal opening 34*a* is an attachment compartment. The horizontal opening 34*a* is also a connection and disconnection area for the handle engagement connections to connect to and disconnect from. The perpendicular opening 34*b*, which runs downward the middle of the horizontal opening 34*a*, runs in the direction away from the blades 14. The perpendicular opening 34*b* is usually smaller in length than the horizontal opening 34*a*, but the perpendicular opening 34*b* can be any size or length. This perpendicular opening 34*b* is a portion of the flange 24 (arms or wing area) where the handle engagement connection is attached. The flange 24 (arms or wing area) runs back and forth within the perpendicular opening 34*b* as the user shaves. When the user shaves and the cartridge face follows the shaving surface, the cartridge can swivel back and forth. While the cartridge swivels back and forth, the flange 24 (arms or wing area) runs back and forth within the perpendicular opening 34*b*.

Figure 14:
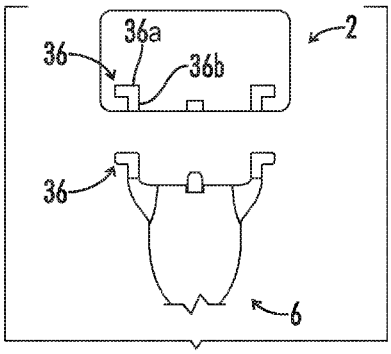
FIG. 14 is a diagrammatic view of one embodiment of a half "T" or "L" connection.
Figure 15:
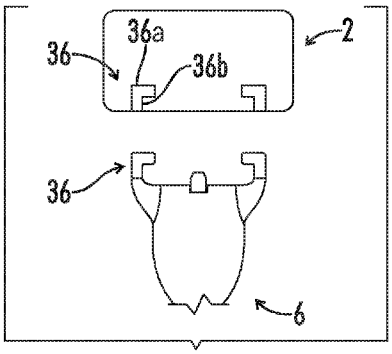
FIG. 15 is a diagrammatic view of one embodiment of a half "T" or "L" connection.

As seen in the embodiment of FIGS. 14 and 15, there can be a half ("½") "T" or an "L" connection 36, where the upper horizontal section 36*a* of the connection area resembles the ½ "T" or "L" that the lower leg portion 36*b* is connected to. The upper horizontal portion 36*a* of the "T" would only be shaped as the ½ "T" or "L," so that there would only be one section of the horizontal section 36*a* of the "T." This upper horizontal section 36*a* runs toward the outside of the cartridge area, and the inner part of the "T" is eliminated. The cartridge and handle connection area are shaped to match the ½ "T" or "L" connection 36. The inside of the ½ "T" or "L" connection may have a snap connection or any connection possible. The inside of the connection area can also have a bump area as described herein to hold the handle engagement connection in place. There can be one to any number of bumps (FIG. 22) located anywhere in and around the compartment area. If the handle engagement connection 22 has a half "T" connection 36, then the cartridge attachment compartment 20 will also look like a half a "T, so that the handle engagement connections 22 fit inside perfectly.

Figure 16:
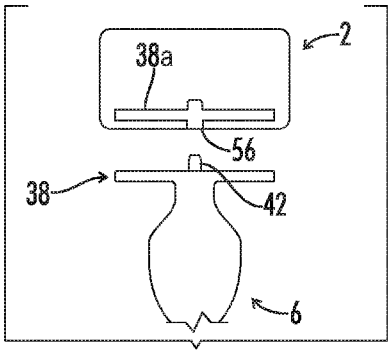
FIG. 16 is a diagrammatic view of one embodiment of an elongated or long bar connection.

As seen in the embodiment of FIG. 16, another type of ½ "T" connection 38 is when an upper horizontal portion 38*a* of the "T" would only be shaped as the ½ "T," so the there would only be one section of the horizontal portion 38*a* section of the "T". This upper horizontal portion runs toward the middle pushpin engagement 56 area on the cartridge face. This is an opposite ½ "T" connection 38 from the ½ "T" 36 embodiment described above, represented by FIGS. 14 and 15. The outside of the cartridge attachment compartment area and the outer handle engagement connections are eliminated in this embodiment. The cartridge attachment compartment area and opening on the cartridge would be shaped to match the ½ "T" connection 38 on the handle 6, for a perfection connection.

Figure 17:
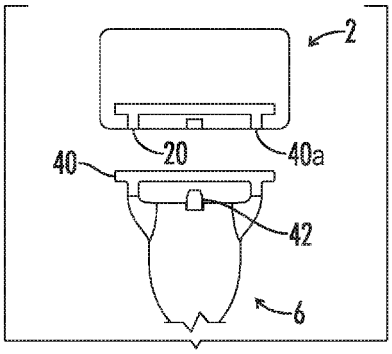
FIG. 17 is a diagrammatic view of one embodiment of an elongated or long bar connection.

As seen in the embodiment of FIG. 17, another type of connection on the end of the handle engagement connection area can be one long bar 40 that fits into the cartridge attachment compartment area, running along the cartridge face 8, that is also shaped as one long bar 40. The middle of that cartridge attachment compartment 20 area can have a recessed area where the long bar engagement area 40*a* goes. A pushpin 42 on the handle 6 can also be built into the middle of the long bar 40 area to engage with the cartridge long bar engagement area 40*a*. The long bar 40 connection can have one long bar, running along the front of the handle 6, connected to two flanges (arms or wing area) 24. The middle section can be wide enough so the flanges (arms or wing area) 24, which hold the long bar handle engagement connection 22, would have enough room to move up and down as the cartridge 2 and handle 6 shave different surfaces and contours. The cartridge 2 and all other specifications that have been discussed can apply to this or any type of dual sided cartridge 2, handle engagement connections 22, and handle 6.

In another embodiment, there could be another type of connection area that resembles an "F" connection (not shown) on the left side and a reverse "F" connection on the right side. Or, both "F" shaped areas can be the same, while across from each other, and this would be located on the cartridge attachment compartment 20 area. The handle engagement connections would be shaped to match the cartridge attachment compartment. The handle engagement connection would have connections that fit into the cartridge attachment compartment area on both sides of the cartridge face, and the "F" connection would swivel inside the cartridge. In an "F" connection, the handle engagement connections can have two connections on each side of the arm or leg that connects to the cartridge attachment compartment area. The handle or cartridge and all other specifications that have been discussed can apply to this type or any type of handle and dual sided cartridge connection.

In another embodiment, another type of connection involves using any of the mentioned ways of attaching the handle 6 to the dual sided cartridge 2.

Figure 18:
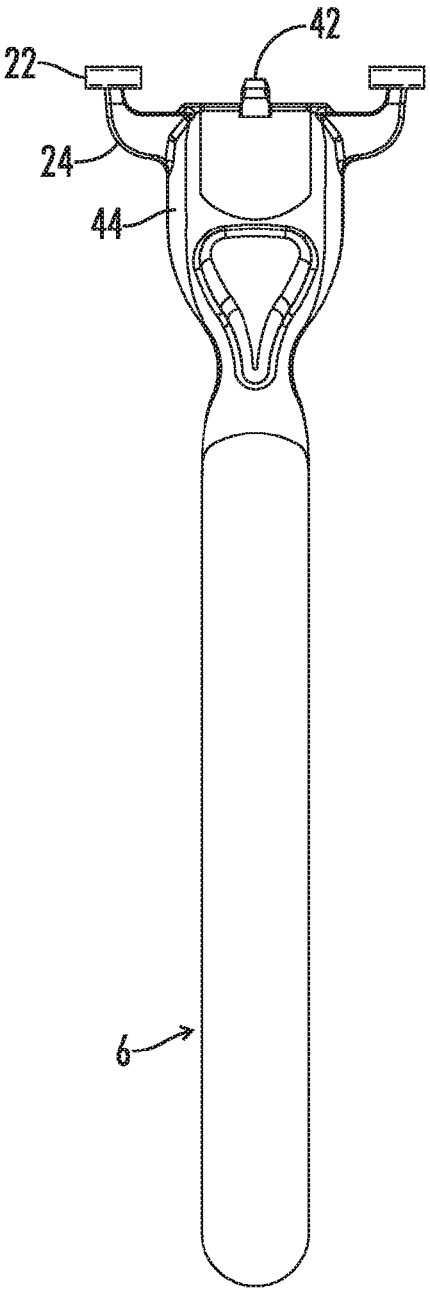
FIG. 18 is a front view of one embodiment of a handle of the present disclosure.

As seen in the embodiment of FIG. 18, the connection has a pushpin 42 designed on the end of the handle 6 close to the pushpin area. In one embodiment, the pushpin 42 assists in connecting and releasing the handle engagement connection from the cartridge face 8. The handle engagement connections 22 have special connection parts that connect to the cartridge face and lock it into place. When a user pushes a button on the handle 6, the handle 6 and the handle engagement connection 22 will be released from the cartridge 2. This button can be designed any way known now or designed in the future. The button can be any shape or size. In another embodiment, the pushpin simply facilitates the gliding movement of the cartridge relative to the handle and assists with the angling of the cartridge relative to the handle, and does not function to connect and/or release the cartridge relative to the handle.

The handle engagement connections 22 can be located anywhere along the cartridge face 8. The handle engagement connections 22 can be designed to fit and lock in place on the cartridge attachment compartment 20 face, edges, or anywhere on the razor cartridge 2. The handle 6 or cartridge 2 and all other specifications that have been discussed can apply to this type or any type of handle 6 and dual sided cartridge 2 connection.

Figure 20:
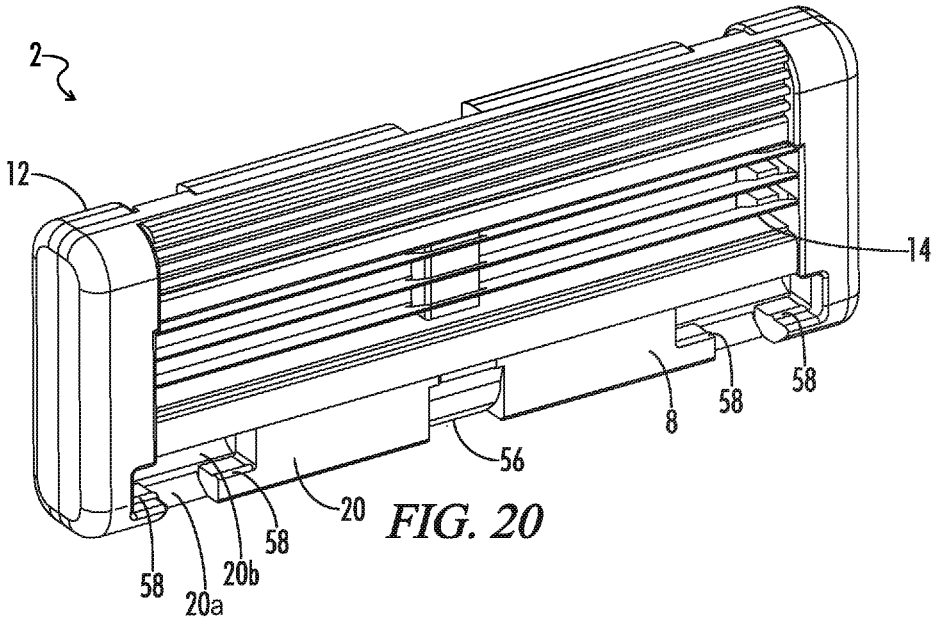
FIG. 20 is a perspective view of one embodiment of a cartridge of the present disclosure.
Figure 21:
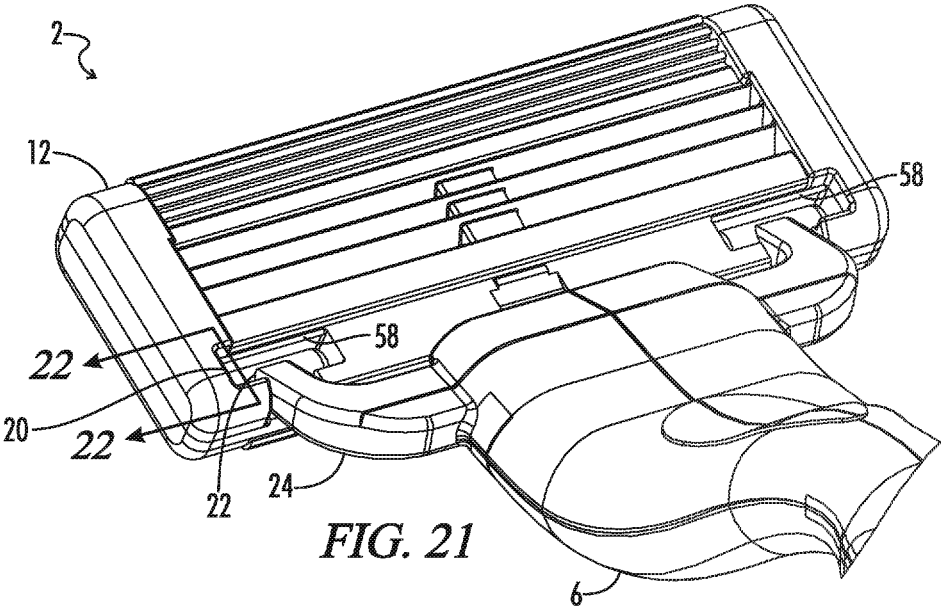
FIG. 21 is a perspective view of one embodiment of a cartridge of FIG. 20 connected to an embodiment of a handle of the present disclosure.

The handle 6 could have flanges (arms or wings) 24 that extend from the handle 6 and have the same type of pushpin 42 that has been described in this application. Also as seen in the embodiment of FIGS. 20 and 21, the handle engagement connections 22 can snap on the outside of the dual sided cartridge ends 12. This is the long end of the cartridge 2. The handle engagement connections 22 would connect to the cartridge center or any location on the ends of the dual sided razor cartridge. The handle engagement connections 22 can snap and lock in place or connect any way known now or developed in the future. Once the handle engagement connections snap and lock in place, there would be a connection, and the first side of the dual sided razor would be ready to use (FIG. 21). The pushpin 42 and the pushpin engagement 56 area will allow certain shaving angles, such as those already described in this application.

When the user has finished using the first side of the cartridge 2, and the blades on the first side become dull, then the user will move the handle 6 and cartridge 2 to the other side, the other side being the second side of the dual sided cartridge. This is accomplished with the handle engagement connection 22 and the cartridge attachment compartment 20, into which the handle engagement connection 22 is attached. The handle 6 and cartridge 2 move in one direction to the other side where the handle 6 will be in a position such that the second side of the dual cartridge 2 can be used. This is where the handle and cartridge will lock into position.

When the user is done, the user can simply disconnect the handle engagement connection 22 from the cartridge attachment compartment 20. The user can put a fresh dual sided cartridge on the handle engagement connection 22 and shave again. The connection area on the outside end of the cartridge 2 can be any connection type and any shape or size developed now or in the future. The handle engagement connection 22 to this cartridge 2 can be U shaped (FIG. 22), or any shape known now or developed in the future. The handle engagement connection 22 can have a snap fit connection or any connection known now or developed in the future. The end connection and handle engagement connection 22 can have a designed route mechanism. This designed route mechanism involves the handle 6 and cartridge 2 turned one way, back and forth, from position (side) one to position (side) two. The designed route mechanism also involves locking the handle 6 and cartridge 2, unlocking the handle 6 and cartridge 2, and switching to the other side easily. The pushpin will be used as already described in this application. The pushpin can be modified slightly to work with this type of swivel, dual sided razor.

Figure 19:
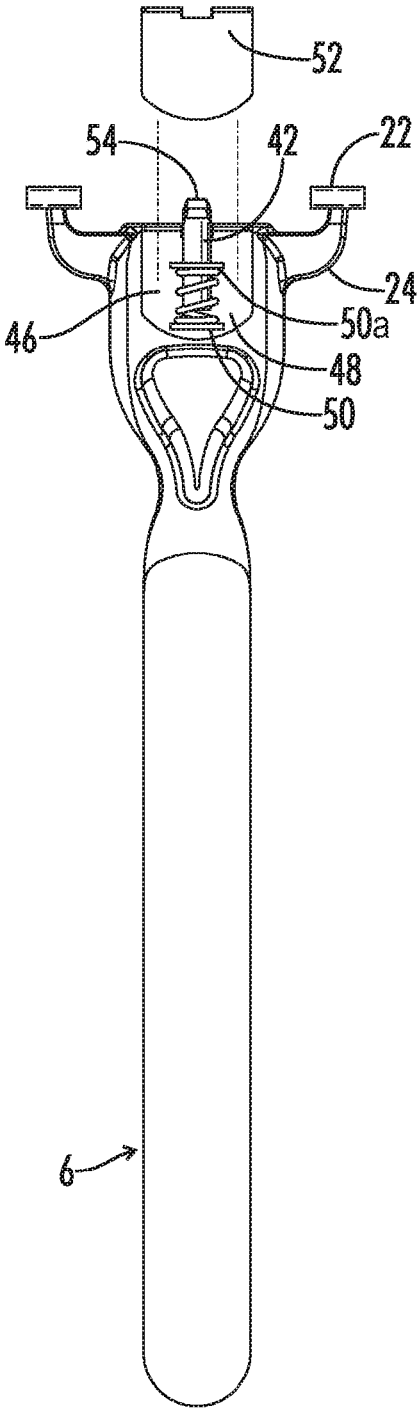
FIG. 19 is a partially exploded view of the handle of FIG. 18 showing one embodiment of a spring pin connection.

As seen in the embodiment of FIG. 19, a spring-loaded pushpin 46 is located on the handle 6 end and works like typical cartridge razors, except most typical cartridge razors have the pushpin go through a swivel attachment area that is already attached to the cartridge. Typically, this swivel attachment area swivels back and forth on the cartridge while the user shaves.

One embodiment of the present invention has a removable handle engagement connection 22 area that attaches directly to the dual sided cartridge face 8 (both sides) and not to a swivel attachment area that is already attached to the cartridge 2. The pushpin of the present disclosure is attached to the handle end and does not go through the swivel attachment compartment already connected to the razor. The pushpin 42 is located in a compartment 48 (FIG. 19) on the handle end, located in-between the two handle engagement connection areas.

In the compartment 48, there is an area for a spring 50 to be placed securely so that it does not move around. Then, the pushpin 42 is attached to the spring end that will be facing the razor cartridge 2 end. Then, a cover 52 is placed over the compartment 48 covering the spring 50 and pushpin 42 portion. The compartment 48 is designed to allow the pushpin 42 to stick out of the compartment 48 facing the razor cartridge 2 area, and the pushpin 42 can be pushed back and forth within the pushpin compartment 48 without coming out. The pushpin 42 has a stop end 50*a* that prevents the pushpin 42 from coming out of the compartment 48 area.

The pushpin 42 is designed so that when it sticks out to its fully extended point beyond the compartment 48 area, the pushpin 42 touches a pushpin engagement area 56 on the cartridge face 8, as seen in FIG. 20. There would be one pushpin engagement 56 area on each side of the cartridge face 8. The pushpin engagement area 56 would be located on opposite ends from each other and on the other side of the cartridge 2. The pushpin 42 will usually be located in the middle, in between the cartridge compartment attachment area 20 of the cartridge face 8. The pushpin engagement area has a surface area that the pushpin 42 touches and can be any type or shape of surface, whether concave or convex. A slightly rounded convex surface is shown that is lower than the surface of the compartment attachment areas 20 or sides and/or cartridge face 8, cartridge 2, or the shaving surface face.

The spring-loaded pushpin 46 is designed to push the cartridge 2 to a first position of the shaving angle. As the user shaves and runs through various contours of the shaving surface, the pushpin allows the cartridge 2 to have pressure on it to stay on the desired shaving surface. When the user applies pressure to the shaving surface, the cartridge 2 maintains the correct shaving position at all times, as long as the user applies pressure to the surface and follows the surface being shaved. The razor cartridge 2 will run over many surface and contour types and shapes, and it will always maintain even contact with the surface via the spring-loaded pushpin 46.

If the maximum shaving angle position was ten, then there would be many different angles within position one and ten through which the cartridge moves. During the entire time, the spring-loaded pushpin 46 allows the cartridge to always go back to the first or rest position one when the dual sided razor cartridge is not in contact with the shaving surface or is not in use.

If the spring-loaded pushpin 46 feature were not in place in one embodiment, then the razor cartridge 2 would not stay in any particular shaving angle during shaving. If there were no spring-loaded pushpin 46, then the user would not have a smooth, even shave to the angle or contour being shaved, as the user shaves and applies pressure to the shaving surface. The razor cartridge 2 would not be able to maintain an even contact to the shaving surface while applying pressure. The spring-loaded pushpin 46 helps the razor cartridge 2 maintain the right, even position of the shaving area. When the razor is taken off the shaving surface, the spring-loaded pushpin 46 pushes the cartridge back to the initial position or shaving angle.

As also seen in FIG. 20, the attachment compartment area 20 on the cartridge face is where the handle engagement connection area connects to the attachment compartment on the cartridge face. This attachment compartment area usually matches the handle engagement connection shape. However, the attachment compartment area surface can be any size, angle, shape, or design. The inside of the cartridge attachment compartment area can be any size, angle, shape, or design as well.

The compartment attachment area has a perpendicular opening 20*a*, which is perpendicular to the horizontal opening 20*b* of the attachment compartment 20 that goes downward (away from) the blades 14. There are two sides in the interior portion of the attachment compartment area's perpendicular opening 20*a*, which are located to the right and left of the perpendicular opening 20*a*. This area also helps hold the handle engagement connection 22 in the attachment compartment 20 as the handle engagement connection 22 swivels back and forth in the attachment compartment 20.

The inside of the attachment compartment 20 area can have one to any number of retainers or bumps 58 on the attachment compartment 20 area opening, anywhere on the interior area, anywhere on the sides of the interior area, or anywhere on the interior walls. There can be one retainer or bump 58 on the back wall and one on each side of the front wall. Or, there can be one bump 58 on one side of the front wall and one on the back wall. There can be any number of combinations of bumps 58 that are of any size, angle, shape, or design. The bumps 58 have a design that is known now or developed in the future to accomplish the same purpose. The bumps 58 act as a retainer, holder, snap fit area, engagement area, or passageway for handle engagement connection 22 to fit into and stay inside the attachment compartment area 20, and not come out unintentionally. While a bump is shown and described, it will be appreciated that any other type of retainer other than a bump may be used.

The bumps 58 on the attachment compartment 20 area opening can also make the attachment compartment 20 area smaller than the handle engagement connections 22, so that when the handle engagement connections 22 go past the bumps 58, there is a little tighter resistance between the two pieces (the two areas). Then, when the user uses a little force, the handle engagement connection 22 goes into the attachment compartment 20, and the handle engagement connection 22 connects inside the attachment compartment 20.

Figure 22:
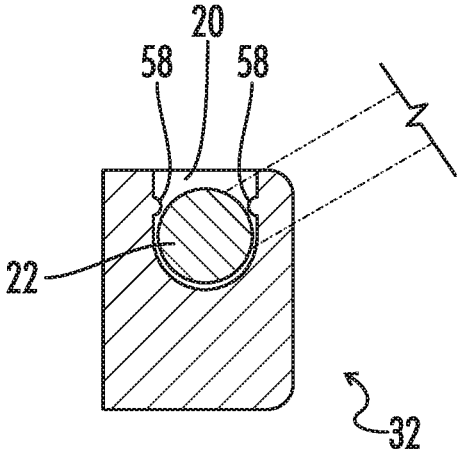
FIG. 22 is a cross-sectional taken along line 22-22 in FIG. 21.

FIGS. 21 and 22 show where the handle engagement connection 22 can swivel freely within the attachment compartment 20 without coming out easily. The bump 58 design, attachment compartment area type of connection, or any similar connection can have any design known now or developed in the future to accomplish the same concept.

In a "T" connection (see FIG. 13 for example), both sides of the "T" horizontal portions would fit inside the sides of the attachment compartment area perpendicular openings 34*b*. The swivel action back and forth generally happens when the user shaves and the razor cartridge 2 follows the contour of the shaving surface and allows the cartridge 2 to adjust to the shaving surface angle. When this happens, the handle engagement connection 22 swivels back and forth within the attachment compartment 20 and/or the attachment compartment 20 area swivels back and forth, around or on, the handle engagement connections 22. The perpendicular area 20*a* in the attachment compartment 20 can be located on the face or the long side of the razor, and it can follow the razor's edge shape. The perpendicular area 20*a* can be any angle, design, shape, and can be located anywhere. The horizontal compartment 20*b* can be located anywhere and have any size, angle, shape, or design.

Also as seen in FIG. 22, this invention has a removable handle engagement connection 22 area that attaches directly to the cartridge face 8 and not to a swivel attachment compartment area 32 that is already attached to the cartridge 2 like most razor cartridges in the market.

When the user wants to disconnect the handle 6 from the attachment compartment 20 area on the cartridge face 8, the user would hold the handle 6 with one hand and would hold the dual sided cartridge ends 12 (the sides where there are no blades 14) with the other hand. Then, the user would pivot the cartridge into a disengagement position and pull the handle engagement connection 22 areas on the handle 6 out of the cartridge attachment compartment 20 on the cartridge face 8 with a little force. To make it easier to disconnect, the handle 6 and the handle engagement connection 22 can be perpendicular to the attachment compartment 20 (see FIG. 4) on the cartridge face 8. However, when connecting and disconnecting the handle engagement connections 22 and handle 6 from the razor cartridge 2, the handle engagement connections 22 and handle 6 need not be perpendicular to the cartridge face 8. The handle engagement connections 22 can be any angle, but it is preferred for an easier connection and disconnection if the handle engagement connection 22 was perpendicular to the cartridge face 8 as shown in FIG. 4. The handle engagement connection 22 area can be connected to the cartridge attachment compartment 20 on the cartridge face 8 one compartment at a time or simultaneously, depending on the user's preference.

Figure 23:
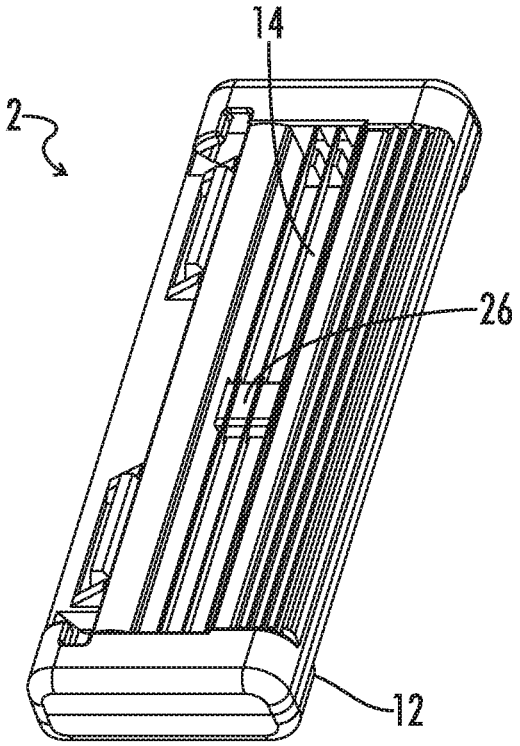
FIG. 23 is a perspective top view of one embodiment of a cartridge.
Figure 24:
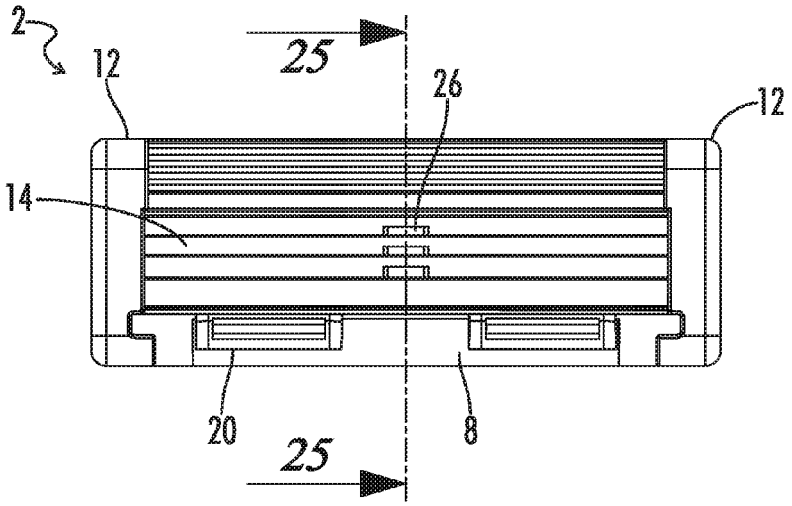
FIG. 24 is a front view of one embodiment of a cartridge.
Figure 25:
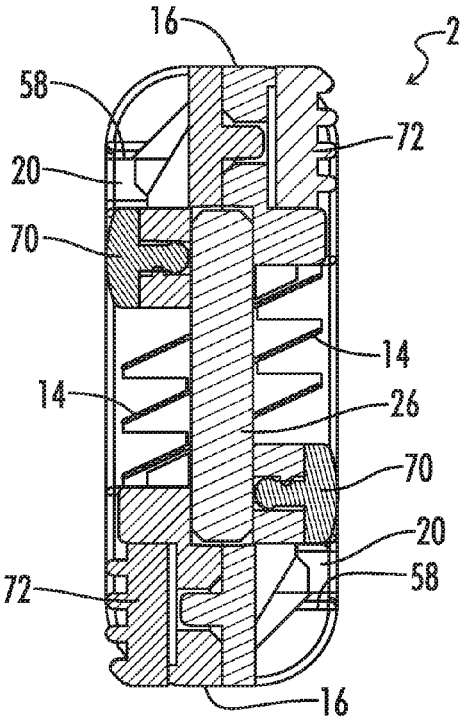
FIG. 25 is cross-sectional view taken along line 25-25 of FIG. 24.

The blades 14 in the cartridge 2 can be any number. They can have sets of blades 14, such as one on each side, two on each side, three on each side, four on each side, or five on each side, and so on. As seen in FIGS. 23-25, the blades 14 can run all the way through to the other side of the dual side cartridge 2. Or, the blades 14 do not have to run all the way through to the other side of the dual side cartridge 2. The blades 14 can be flat, or the blades 14 do not have to be flat. The blades 14 can be any shape. There can be any number of blades 14, such as one to five blades for example, with a cutting edge on each side. The blades 14 can have the same side cutting edge on each end or opposite cutting edges on both sides. The top end of one side can be the cutting end and the opposite end of the blade 14 can have the cutting end on the top end. Or, there can be opposite cutting ends or be the same. The blades 14 can be sharp on both ends and can be cut on any edge or angle. The blades 14 can be tapered on both ends so that the blade 14 ends are to a point and sharp to the end point of the taper. The blades 14 can be sharp or the cutting edge of the razor blade 14 or design can be any way known now or developed in the future. The blades 14 can be made of any steel known now or developed in the future. The blades 14 can be made of any type of material that can cut or shave. The blades 14 can have section or shapes in the blade 14 able to be fastened to the cartridge 2 safely and securely.

The blades 14 can have stabilization parts to hold the blades 14 in place. There can be any number of blade centerpieces 26 (FIG. 23) that stabilize the blades, and they can be any shape or size or design known now or developed in the future. These blade centerpieces 26 can allow for a straight and even shave with the blades 14 staying straight and even. They are also safety measures of keeping the blades 14 secure within the cartridge 2 or any location within the cartridge 2. The blade centerpieces 26 can be angled, run in any direction vertically or horizontally, or have any angle within the dual sided razor blade 14. There can be holes where the blades 14 have plastic, any fastening pieces, or material to hold the blades 14 in place on any part of the dual sided cartridge 2. The blades can have any thickness or size. The blades 14 can have any shape and any outside perimeter shape. The blades 14 can have a coating of any materials known now or developed in the future to aid the blade from becoming dull. The blades 14 can be fastened to the dual sided razor cartridge 2 in any location within the cartridge 2 or razor.

The razor blades 14 can be spaced any distance from one another, be in layers, and staggered at an angle from one another. The blades 14 can be angled the same degree on one side of the cartridge face 8, and if the cartridge 2 was flipped (turned to the other side; i.e. where the first side is a mirror image of the second side along an axis defined through a center of a longitudinal axis of the cartridge), the angle would be the same. When the blade 14 ends are around a 60-degree angle on the shaving surface, for example, the blade 14 goes through to the other side of the razor cartridge 2, as seen in FIGS. 24 and 25. On the cartridge 2 shaving side, the razor blade 14 angle is facing downward toward the handle 6 end. When the other cartridge 2 shaving side is not in use, the blades 14 are facing upward away from the handle 6 end.

When the user disconnects the dual sided razor cartridge 2, flips it (turns to the other side), puts it on the handle engagement connection 22, and connects it to the cartridge attachment compartment 20 area, then the blade 14 shaving angle is the same as it was earlier on the shaving surface. The blade 14 is angled downward toward the handle end, and when the other cartridge 2 side is not being used, the blades 14 are angled upward away from the handle 6 end. The blade 14 angle from the outside cutting edge is at an angle to the shaving surface to allow a close, safe shave. There are many ways of attaching and setting blades 14 and blade 14 angles for a quality shave, and this embodiment includes any way known now or developed in the future for a dual sided cartridge concept herein.

The cutting surface is the area where the blade 14 cutting edges are located in relation to the shaving surface, cartridge 2 surface, and in relation to the pad or moisturizing pad surfaces. The blade 14 cutting edges, on both sides of the dual sided razor, can be located at any level (below or above), or at the same level of the pad, moisturizing pad, strip, shaving surface, cartridge 2 surface, shaving cartridge 2 surface, face, or any surface described herein. The outer surfaces of the cartridge 2 can be lower than the actual shaving surface. The shaving surface can be higher than the outer surfaces of the cartridge 2. The shaving surface may or may not include pads, strips, moisturizing pads, the cartridge 2 section on the middle, edges (outer portions), or inner portions.

Figure 26:
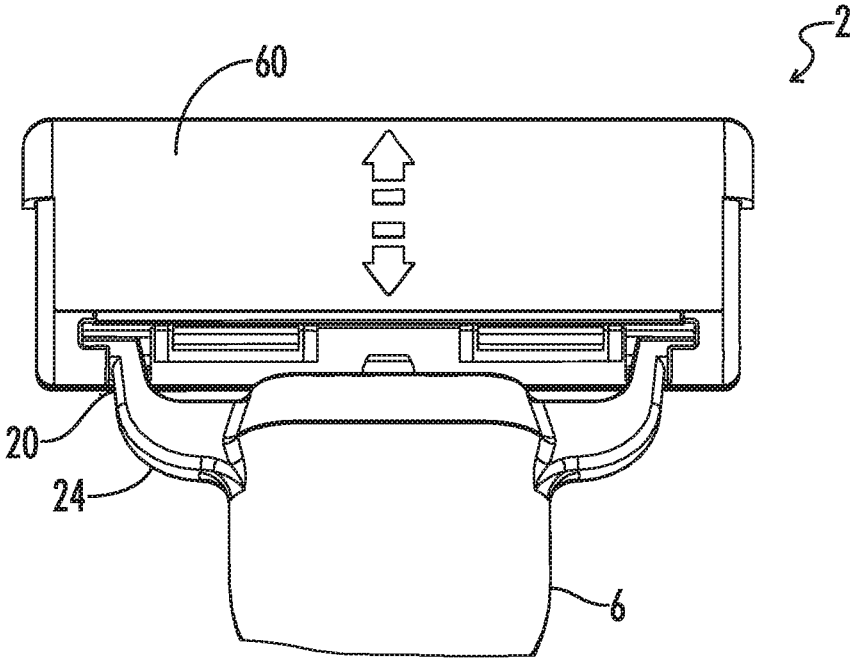
FIG. 26 is a rear view of one embodiment of a cartridge with a cover.
Figure 27:
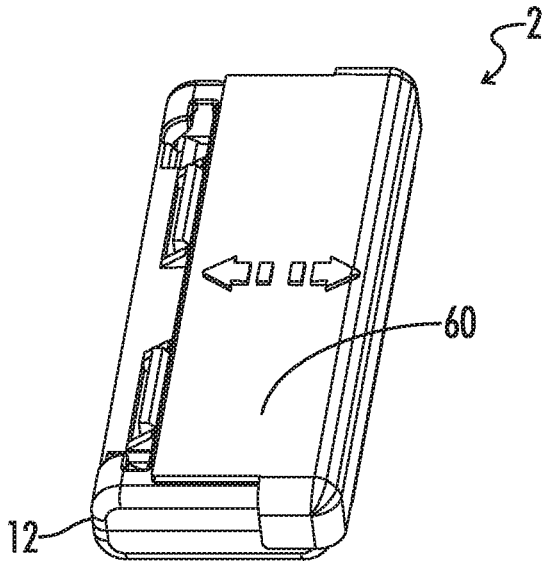
FIG. 27 is a perspective top view of one embodiment of a covered cartridge.
Figure 28:
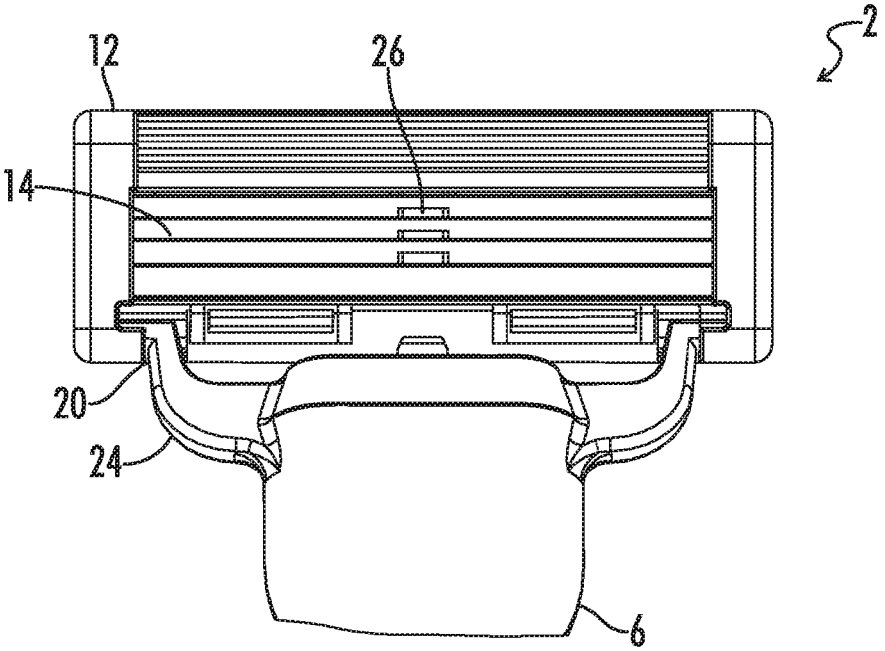
FIG. 28 is a rear view of one embodiment of a cartridge connected to a handle.
Figure 29:
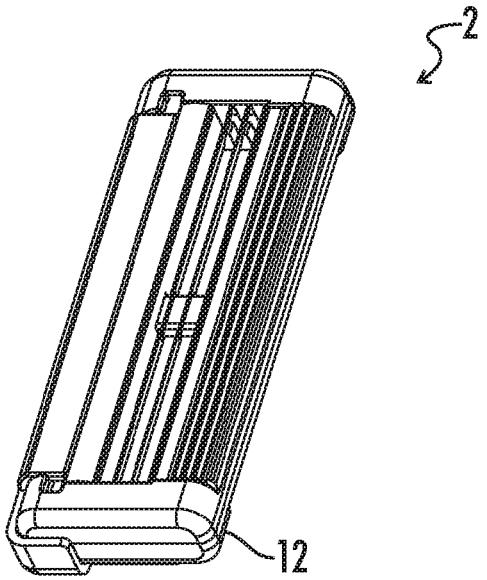
FIG. 29 is a perspective top view of one embodiment of cartridge with a cover attached to the opposite face.
Figure 30:
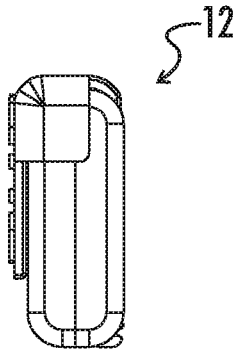
FIG. 30 is a side view of the cartridge of FIG. 29.
Figure 31:
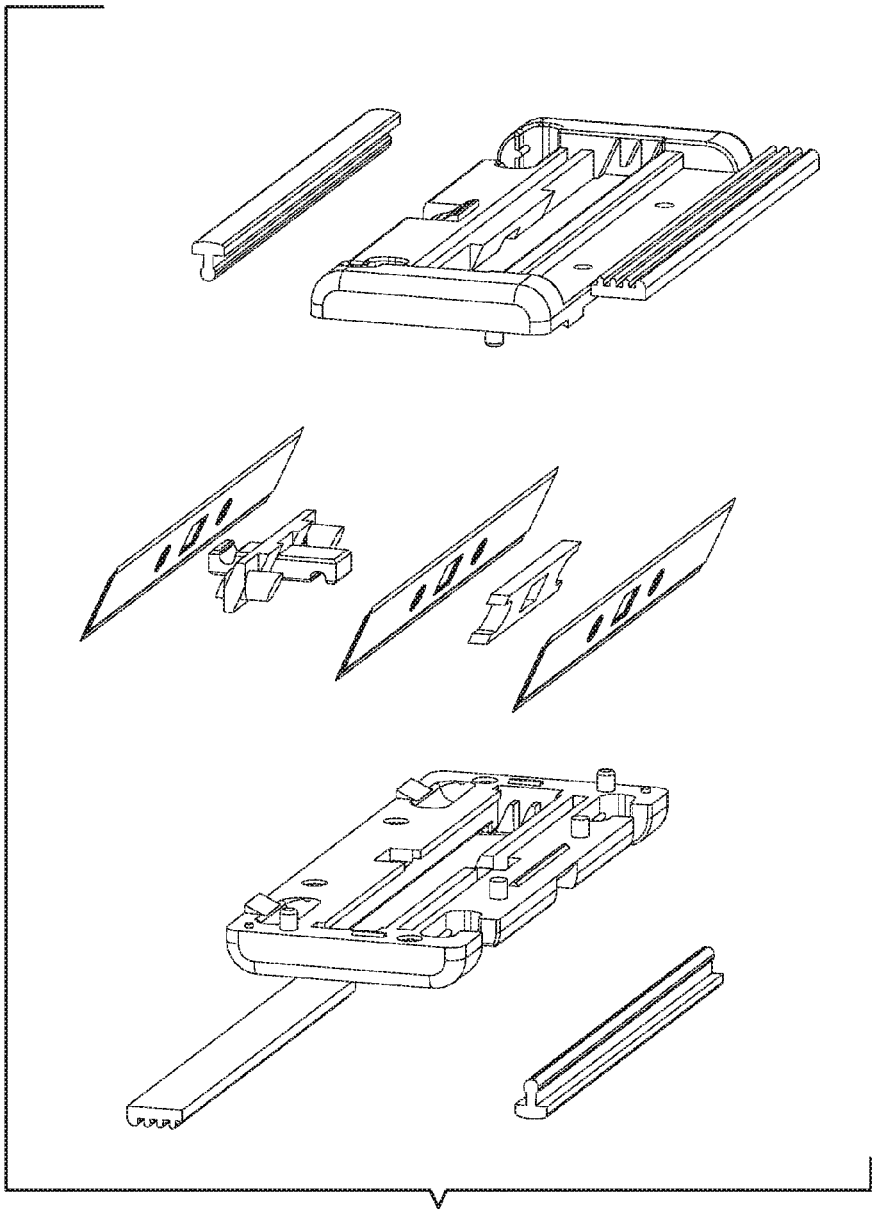
FIG. 31 is an exploded view of one embodiment of a cartridge of the present disclosure.
Figure 32:
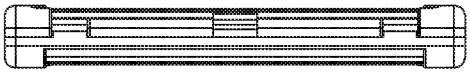
FIG. 32 is atop edge view of one embodiment of a cartridge of the present disclosure.
Figure 33:
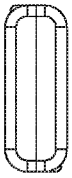
FIG. 33 is a left side elevation view thereof.
Figure 34:
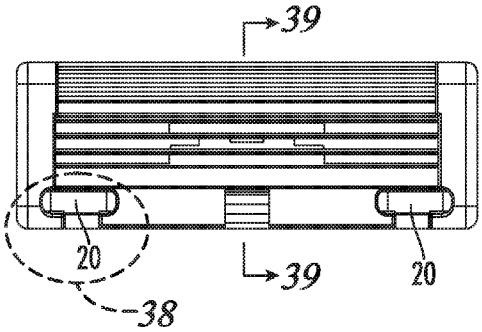
FIG. 34 is a front plan view thereof.
Figure 35:
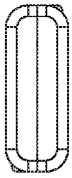
FIG. 35 is a right side elevation view thereof.
Figure 36:
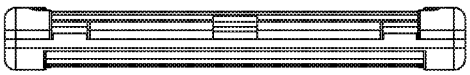
FIG. 36 is a bottom edge view thereof.
Figure 37:
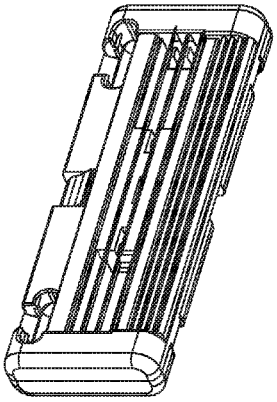
FIG. 37 is a top perspective view thereof.
Figure 38:
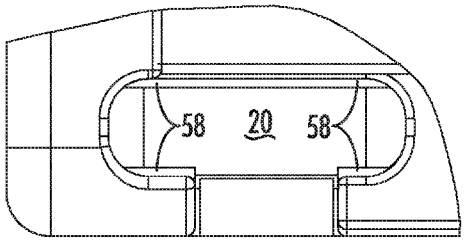
FIG. 38 is a close-up of the circled portion 38 of FIG. 34.
Figure 39:
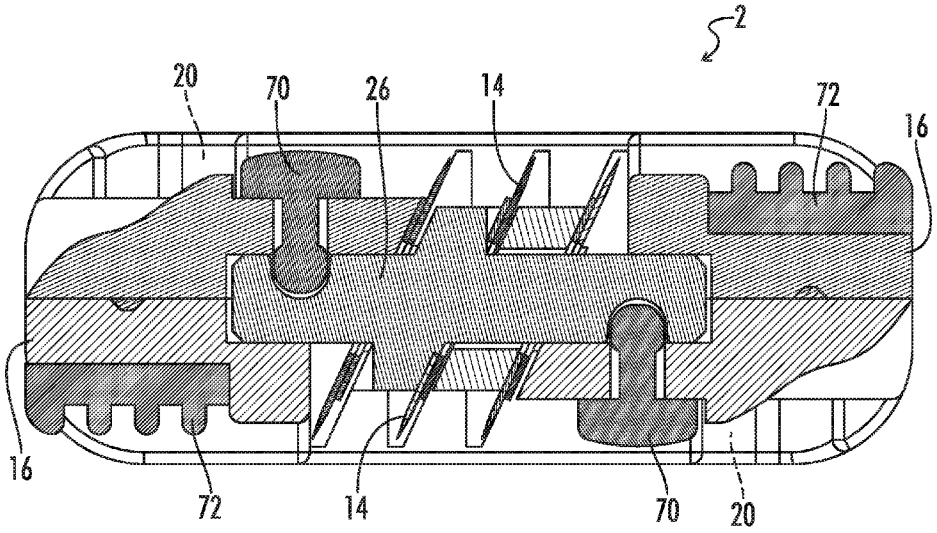
FIG. 39 is a cross-section taken along line 39-39 of FIG. 34.
Figure 40:
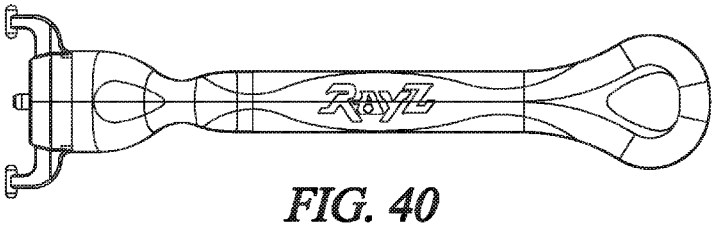
FIG. 40 is a top view of one embodiment of a handle in accordance with the present disclosure.
Figure 41:
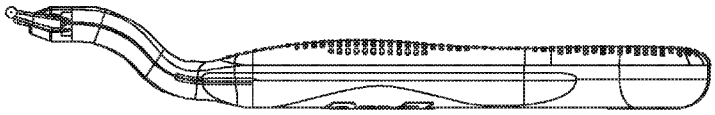
FIG. 41 is a side view thereof.
Figure 42:
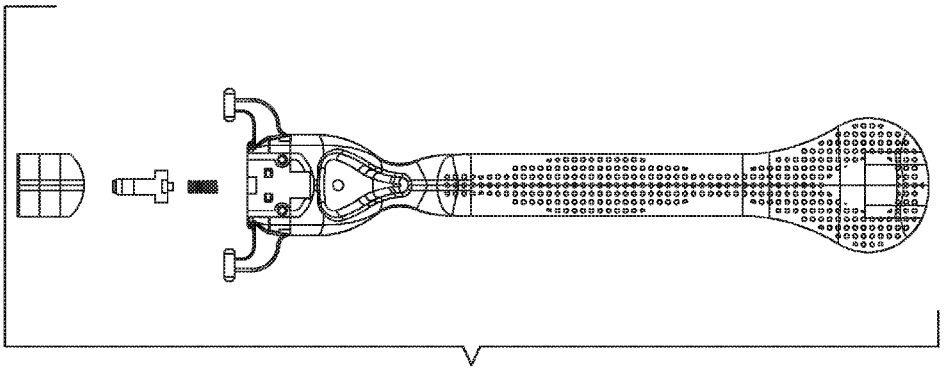
FIG. 42 is a bottom exploded view thereof.

As seen in FIGS. 26 and 27, a cover 60 (cap) can be designed to go over (shield) one side of the cartridge 2 not being used. There could also be a cover 60 (cap) that goes over (shields) the handle 6. The dual sided cartridge 2 can be designed so that the cover 60 (cap) can cover the blades 14 and the part of the cartridge 2 not being used. As seen in FIGS. 28 and 29, the blades 14 and part of the cartridge 2 are uncovered because they will be used. The cover 60 (cap) can slide over the cartridge 2 or snap attachments to the cartridge 2. It will protect people from being cut with the backside of the razor while not in use. The cover 60 (cap) can cover a part of the top of the cartridge 2 edge, edges, or any part of the cartridge 2. Then, it can cover the razor cartridge face 8, leaving the attachment compartment 20 and pushpin engagement area still exposed. As seen in FIG. 30, the cover 60 (cap) can also go over (shield) the cartridge ends 12 or cartridge face 8 sides. The cover 60 (cap) can be taken off during use to rinse the hairs through the blades 14, and then it could be put back on if needed. This can be any size, shape, or design and be made of any material known now or developed in the future. The handle 6 or cartridge 2, and all other specifications that have been discussed, can apply to this type or any type of dual sided cartridge 2 and handle 6 connection.

There can be one to several pads or pad strips located anywhere on the cartridge 2 to aid in shaving and allowing a smooth shave. The pads or strips can be any size or shape and can be fastened to be removable or permanent. They can have aloe vera, vitamin E, any type of skin lotion, skin aid, or anything that is good for the skin and good for shaving. The pads can be smoothly shaped (see pads 70 in FIG. 2 for example) or have grooves, ridges (see pads 72 in FIG. 2 for example), or any type of surface. The pad height on the shaving surface can be any height from the shaving surface. It can be flush with the shaving surface, higher, or lower. It is preferable that the pad height is higher, so that the pad could help aid the skin surface while shaving. Any pad, strip, or moisturizing strip known now or developed in the future can be used for this dual side razor cartridge.

A dual sided disposable razor can have all the specifications replaceable and elements that have been mentioned in this application. The dual sided disposable razor can be any shape, design, size and be made of any material known now or developed in the future.

One difference between a dual sided disposable razor version and a version that is not disposable is that the disposable blades 14 and cartridges 2 might be made of less expensive materials and designed to be used only once and thrown away. The user would use one side of the dual sided disposable razor, and when done or when the blades 14 are dull, flip it (turn it over to the other side) and use the other side of the razor. The user would get twice the shave as disposable razors and save them money in the long run.

The concept of the present embodiments allows the user to use both sides of the disposable razor blade 14, which will last twice as long, instead of using only one side of a disposable razor. The user would connect and disconnect the handle engagement connection 22 area to the cartridge attachment compartment 20 area as already described in the specifications.

In one embodiment, there can be a dual sided razor stand to hold the dual sided razor cartridge on the bathroom counter, shower, drawer, or any location, for example. It can be designed to hold the dual sided razor cartridge and handle vertically or horizontally. The stand can have drying pads that go in between each blade 14 to keep them dry while not in use.

Figure 43:
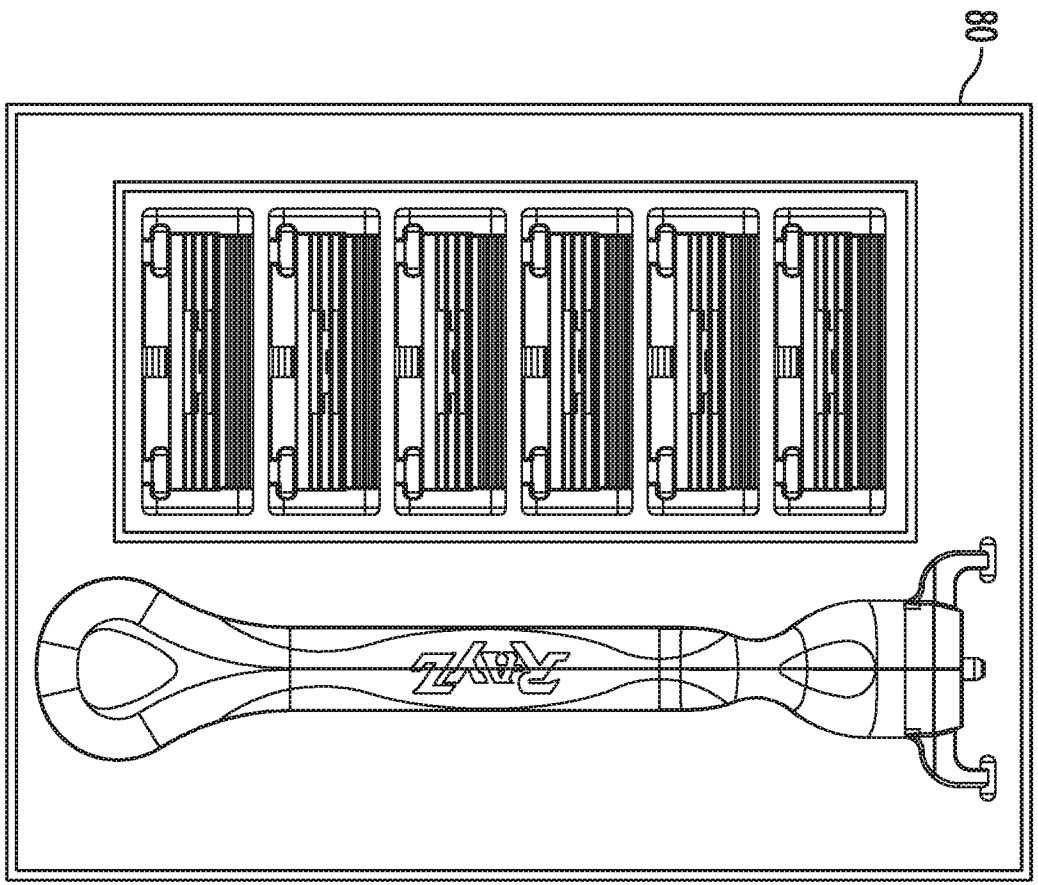
FIG. 43 is a diagrammatic view of one embodiment of a kit including a handle and a plurality of cartridges.

In one embodiment, there can be a dual sided razor cartridge replacement pack or compartment where any number of dual sided razor cartridges can be placed. In one embodiment, the replacement pack can be sold alone or as part of an introductory kit 80 (FIG. 43) including a handle and a pack or a plurality of razor cartridges. These replacement packs can have the dual sided replacement cartridges inside and sold to the consumer. These dual sided replacement cartridges can be used to replace the dual sided cartridge razor when they are dull on both sides. This way, the consumer does not have to keep buying new razor handles and only needs to buy the replacement packs of the dual sided razors cartridges. The dual sided razor cartridges can have a snap fit or be attached snuggly inside the replacement pack or compartments. It can be designed so the user can use the handle engagement connection area, insert it into the cartridge attachment compartment area on the cartridge face, pull out the dual sided cartridge, and begin shaving. The cartridge attachment compartment connection can be facing upward from the base of the replacement pack base, thereby being in the perfect position to be inserted by the handle engagement connection.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A dual sided razor cartridge comprising:

a) a first shaving face and a second shaving face opposite and parallel the first face, b) a plurality of razor blades extending between the first and second faces; and c) at least one handle engagement compartment for engagement of the cartridge with a razor handle; and d) at least one guide on each of the first face and the second face along which a handle pin moves during shaving, e) wherein each of the razor blades extends from the first face to the second face.

2. The dual sided razor cartridge of claim 1, wherein the first and second faces are joined by one of a snap engagement, press fit engagement, ultrasonic welding engagement, or heat welding engagement.

3. The dual sided razor cartridge of claim 2, wherein the at least one handle engagement compartment further comprises a retainer for retaining a portion of a handle within the at least one handle engagement compartment.

4. The dual sided razor cartridge of claim 3, further comprising at least one of a moisturizing strip and a massaging strip on at least one face.

5. The dual sided razor cartridge of claim 4, further comprising at least one of a moisturizing strip and a massaging strip on both faces.

6. The dual sided razor cartridge of claim 5, further comprising a plurality of retainers within the at least one handle engagement compartment.

7. The dual sided razor cartridge of claim 6, wherein the retainer further comprises at least one bump.

8. A dual sided razor cartridge comprising:

a) a first shaving face and a second shaving face opposite and parallel the first face, b) at least one razor blade extending between the first and second faces; and c) at least one handle engagement compartment positioned on each face for engagement of the cartridge with a razor handle;

wherein the at least one handle engagement compartment is circular in cross-section and has an opening that is bounded by a plurality of bumps, and wherein each of the at least one razor blade extends from the first face to the second face.

9. The dual sided razor cartridge of claim 1, further comprising a removable cover attachable to the razor cartridge for covering at least one of the two faces.

10. The dual sided razor cartridge of claim 1, further comprising a removable cover attachable to the razor cartridge for covering at least a portion of one of the two faces while the other face is being used for shaving.

11. The dual sided razor cartridge of claim 1, further comprising grips along opposite edges of the cartridge.

12. The dual sided razor cartridge of claim 11, wherein the grips are grooved.

13. The dual sided razor cartridge of claim 12, wherein the grips are concave or convex or a combination of the two.

14. The dual sided razor cartridge of claim 1, further comprising a plurality of ramped guides.

15. The dual sided razor cartridge of claim 14, wherein the ramped guides are either convex, concave or a combination of the two.

16. A razor comprising:

a) a handle having a handle engagement connection;

b) a dual sided razor cartridge having a first shaving face and a second shaving face opposite and parallel the first face, and further comprising at least one handle engagement compartment for engagement with the handle engagement connection on the handle; and c) a plurality of razor blades extending between the first and second faces, d) wherein each of the plurality of blades further comprises a first free end extending outward relative to the first face and a second free end extending outward relative to the second face, each free end being oriented in the same direction relative to its respective face, e) wherein the first face is a mirror image of the second face along an axis defined through a center of a longitudinal axis of the cartridge, and f) the handle further comprising a handle pin, g) the dual sided razor cartridge further comprising at least one guide on each of the first face and the second face along which the handle pin moves, and h) wherein each of the razor blades extends from the first face to the second face.

17. The razor of claim 16, wherein the at least one handle engagement compartment further comprises a retainer for retaining a portion of the handle engagement connection within the at least one handle engagement compartment.

18. The razor of claim 17, further comprising at least one of a moisturizing strip and a massaging strip on at least one face.

* * * * *